US006374408B1

(12) United States Patent
Tomlinson et al.

(10) Patent No.: US 6,374,408 B1
(45) Date of Patent: Apr. 23, 2002

(54) PROTECTIVE ATHLETIC PAD APPARATUS

(76) Inventors: Davy C. Tomlinson, 215 W. Washington St.; Robert C. Tomlinson, N4944 Highway 51; Julie A. Cross, W8687 Kent Rd., all of Poynette, WI (US) 53955

( * ) Notice: Subject to any disclaimer, the term of this patent is extended or adjusted under 35 U.S.C. 154(b) by 0 days.

(21) Appl. No.: 09/870,791

(22) Filed: Jun. 1, 2001

(51) Int. Cl.[7] ..... A41D 13/00
(52) U.S. Cl. ..... 2/22; 2/16
(58) Field of Search ..... 2/24, 16, 22, 455, 2/242, 267, 911; 128/878, 881, 882; 602/20, 23, 25–27, 62–63, 65

(56) References Cited

U.S. PATENT DOCUMENTS 4,769,854 A * 9/1988 Williams ..... 2/22
4,926,501 A * 5/1990 Goosen ..... 2/22
5,093,931 A * 3/1992 LaBerge et al. ..... 2/455
5,105,473 A * 4/1992 Valtakari ..... 2/455
5,915,529 A * 6/1999 Popowski ..... 2/16
6,024,714 A * 2/2000 Katzin ..... 602/62
6,098,208 A * 8/2000 Cordon ..... 2/455

* cited by examiner

*Primary Examiner*—John J. Calvert
*Assistant Examiner*—Tejash Patel
(74) *Attorney, Agent, or Firm*—Rodger H. Flagg

(57) ABSTRACT

The protective athletic pad includes padding, which extends across the knee or elbow, and along front and sides of the lower leg or forearm, to further protect the user from abrasion, cuts and bruises while actively engaged in a sport or other strenuous activity. Opposing U-shaped relief openings are provided adjacent to the opposing sides of a user's knee or elbow to increase flexibility. The adjustable protective athletic pad protects the front portion of the user's knee. The athletic pad extends to the user's lower leg and shin, or to the user's lower arm, to protect against abrasion, burns or cuts resulting from falling, or sliding on the ground during strenuous athletic activity. The opposing sides of the athletic pad are adjustably secured with hook and loop fasteners to provide adjustable tension and positioning of the athletic pad. Unlike conventional knee or elbow braces, the fabric and straps used to support the resilient padding are not elastic, enabling the user to adjust the protective athletic pad to suit for ease of running.

17 Claims, 4 Drawing Sheets

PROTECTIVE ATHLETIC PAD APPARATUS

BACKGROUND OF THE INVENTION

1. Field of the Invention

The present invention relates generally to athletic pads, and more specifically to protective athletic pads for sports, to protect a user's limbs when they come in sliding contact with the ground.

2. Description of Related Art

A user's lower leg or forearm at times come in sliding contact with the ground, such as in baseball and softball, when a player slides into a base, or when falling while attempting to catch a ball. Bruises, skin burns and abrasions occur when a player slides on the ground. Other sports, such as tennis, basketball, hockey, lacrosse, rugby, football, soccer, cycling, and track and field events, etc., include the danger of a slide or fall to the ground, which can injure a player's legs or arms.

Thus, what is needed is a protective, flexible support, which absorbs sliding contact and cushions the user's legs or arms during active sports participation. Conventional joint support apparatus is intended to restrict movement of a user's limbs to protect the joint. No provision is made to protect the lower portion of the leg or forearm with conventional joint support apparatus. Elastic backed knee or elbow supports require the pad to be slipped over the foot or hand when put on or removed. This is often uncomfortable, takes time, and does not provide an adjustable fit suitable for each individual.

Several example embodiments of knee or elbow braces found in the art are noted below:

U.S. Pat. No. 6,190,344 B1 issuing to Alec Bobroff on Feb. 10, 2001 discloses an orthopedic support fastening system having slot and strap fastening means for increased stability and support.

U.S. Pat. No. 5,873,848 issuing to John Fulkerson on Feb. 23, 1999 discloses an orthopedic brace having straps which are secured above and below the joint with a hook and loop material.

U.S. Pat. No. 5,865,777 issuing to Gerald Detty on Feb. 2,1999 discloses a geriatric knee brace made of fabric-covered neoprene, which is secured together with Velcro type fasteners.

U.S. Pat. No. 5,727,252 issuing to Richard Oetting on Mar. 17, 1998, discloses a padded knee guard, having first and second protective padding hinged to each other about the user's knee.

U.S. Pat. No. 5,656,023 issuing to Louis Caprio, Jr. et al. On Aug. 12, 1997 discloses an adjustable knee support formed of a layer of neoprene bonded to a nylon outer casing, and a nylon inner lining. Strap extensions wrap around the leg and are secured with hook type fasteners.

U.S. Pat. No. 5,626,557 issuing to Donaed Mann on May 6, 1997 discloses a knee brace having an inflatable bladder.

U.S. Pat. No. 5,472,413 issuing to Michael Detty on Dec. 5, 1995 discloses a universal fit knee and elbow brace with spiders, which is designed to fit all sizes of persons. Mounting straps are arranged to be wrapped in opposite directions around the user's joint.

U.S. Pat. No. 5,451,201 issuing to Randall Prengleron Sept. 19, 1995 discloses a joint support apparatus having a knee cap aperture, and does not extend to protect the user's lower leg or lower arm.

U.S. Pat. No. 5,399,153 issuing to Louis Caprio Jr. et al, discloses an adjustable knee support, having a layer of neoprene bonded to a nylon o9uter casing and a nylon inner lining. The knee support has straps, which extend in opposite directions, and are secured with hook type fastenings.

U.S. Pat. No. 5,383,843 issuing to Randy Watson on Jan. 24, 1995 discloses an air pressure knee brace apparatus, having an air bladder, which is inflated as desired to needed support for the knee joint.

U.S. Pat. No. 5,221,252 issuing to Louis Caprio Jr. et al. On Jun. 22, 1993 discloses an adjustable knee support, which is formed from a single piece of resilient, flexible laminate. A circular opening is provided in the knee cap area.

U.S. Pat. No. 5,086,761 issuing to Patrick Ingram on Feb. 11, 1992 discloses a multi-adjustable knee brace to prevent the kneecap from slippage and to reduce strain on damaged ligaments and/or muscle tissue.

U.S. Pat. No. 5,024,216 issuing to Katuaki Shiono on Jun. 18, 1991 discloses a knee support having a knee opening and a patella pad with two straps for securing the knee support about a user's knee.

U.S. Pat. No. 4,651,722 issuing to Robert Karczewski on Mar. 24, 1987 discloses a knee support structure having an inner layer of resilient material and an outer layer of flexible material. Stiffening material, such as bicycle chain, is disposed between the inner and outer layers.

U.S. Pat. No. 4,388,920 issuing to Mark Hajost on Jun. 21, 1983 discloses a variable position knee immobilizer.

U.S. Pat. No. 4,378,009 issuing to Donald Rowley on Mar. 29, 1983 discloses a brace for injured parts of the body, having four diagonal members forming a criss-cross pattern.

U.S. Pat. No. 4,353,362 issuing to Alexander DeMarco on Oct. 12, 1982 discloses a knee brace of unfolding type, with a wrap-on pad. The pad includes stays to lend rigidity to the braced knee.

U.S. Pat. No. 3,804,084 issuing to Ira Lehman on Apr. 16, 1974 discloses a knee support, having an opening for the knee cap, and is secured to itself with hook and loop fastening means, to provide support for an injured knee while healing.

Thus, what is needed is a protective athletic pad which provides padding along the front and sides of a user's lower leg or forearm, to protect the user's lower leg or forearm while sliding or falling onto the ground, while performing strenuous physical activity.

SUMMARY OF THE INVENTION

The adjustable athletic pad includes resilient padding, which extends across the knee or elbow, and along front and sides of the lower leg or forearm, to further protect the user from abrasion, cuts and bruises while actively engaged in a sport or other strenuous physical activity. Opposing U-shaped relief openings are provided adjacent to the opposing sides of a user's joint, such as a knee or elbow, to increase flexibility. The protective athletic pad protects the front portion of a user's joint, such as a knee or elbow. The protective athletic pad extends to the users lower leg and shin, or to the user's lower arm, to protect against abrasion, burns or cuts resulting from falling, or sliding on the ground during strenuous phisical activity. The opposing sides of the protective athletic pad are adjustably secured with hook and loop fasteners to provide adjustable tension and positioning of the athletic pad. The straps used to connect the protective athletic pad about a user's joint and limb are elastic, enabling the user to adjust the protective athletic pad to suit the user during strenuous physical activity.

BRIEF DESCRIPTION OF THE DRAWINGS

The above mentioned and other features and objects of the invention and the manner of obtaining them will become more apparent and the invention itself will be better understood by reference to the following description of embodiments of the invention taken in conjunction with the accompanying drawings, wherein.

DETAILED DESCRIPTION OF THE SPECIFIC EMBODIMENTS

Figure 1A:
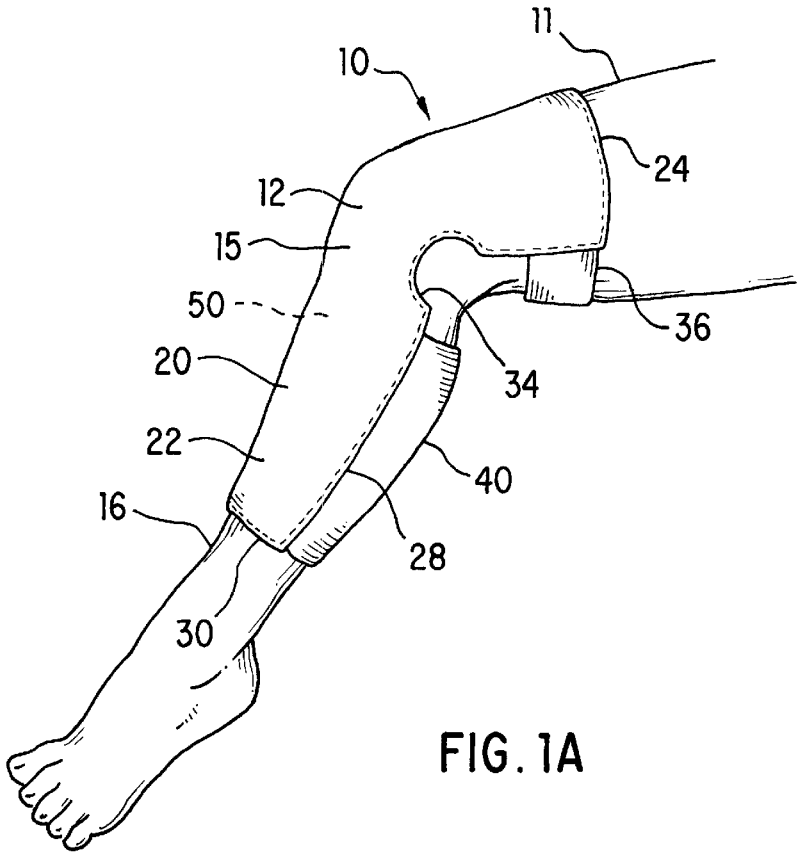
FIG. 1A is a perspective view of the protective athletic pad secured about a user's knee and lower leg.

FIG. 1 through FIG. 5 show the details of the protective athletic pad apparatus 10 disclosed herein. The protective athletic pad apparatus 10 is shown secured about a user's 11 joint 15, such as a knee 12 and lower leg 16 in FIG. 1. A similar protective athletic pad apparatus 10 is shown secured about a user's 11 joint 15, such as an elbow 14 and forearm 18 in FIG. 1B.

Figure 2:
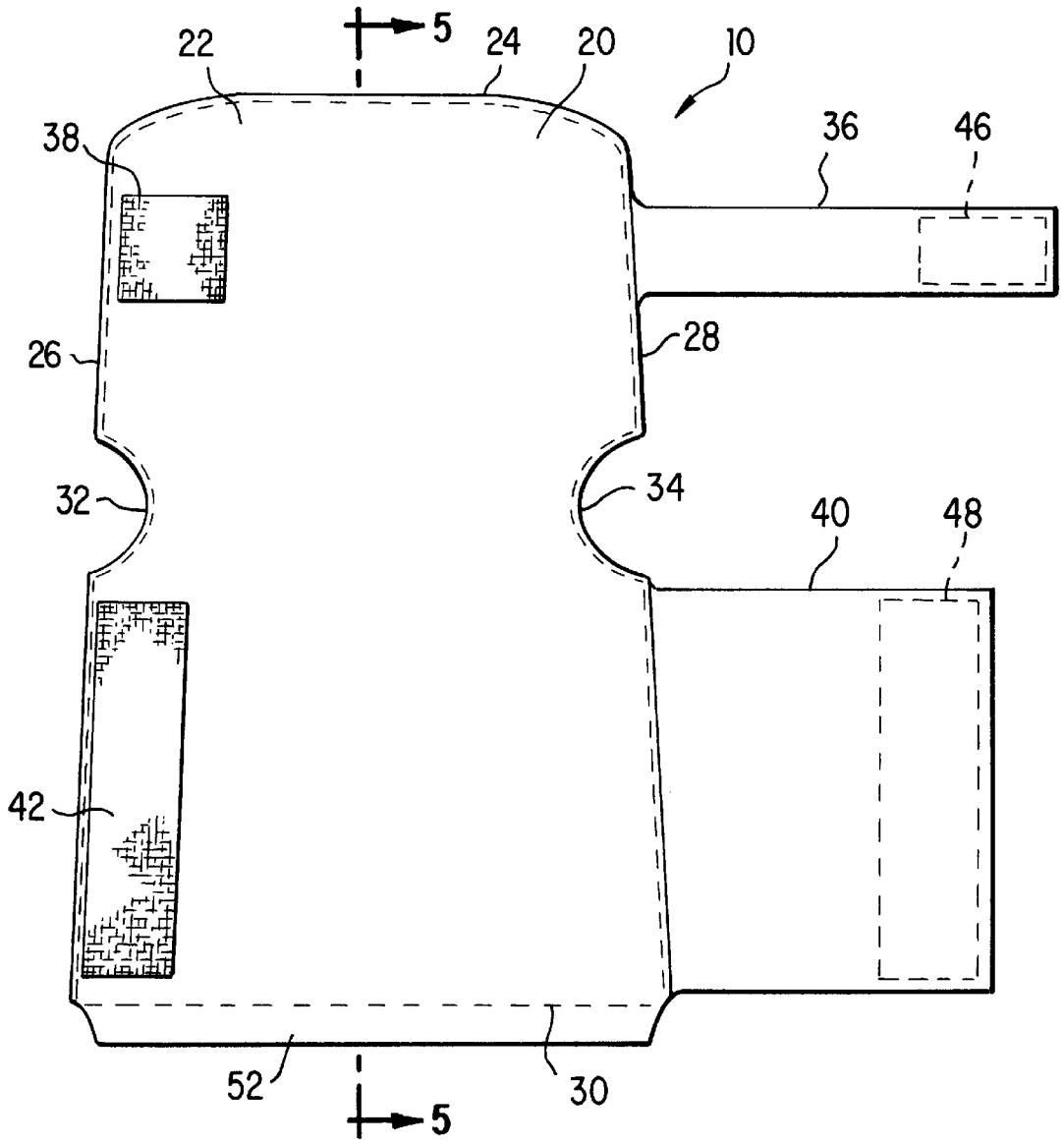
FIG. 2 is a front elevation view of the protective athletic pad.

FIG. 2 is a front view of the protective athletic pad apparatus 10, wherein a suitable fabric 20 covers the front portion 22 of a resilient padding material 50. The front portion 22 includes a top portion 24, a first side portion 26, a second side portion 28 a bottom portion 30, a first relief cutaway 32, and a second relief cutaway 34.

A first, narrow strap portion 36 extends from the second side portion 28, and is sized to extend to a first releasable fastening means 38 located on the front portion 22 adjacent to the first side portion 26, above the first relief cutaway 32. A second, wide strap portion 40 extends from the second side portion 28 and is sized to extend to a second releasable fastening means 42 located on the front portion 22 adjacent to the first side portion 26, below the first relief cutaway 32.

Figure 3:
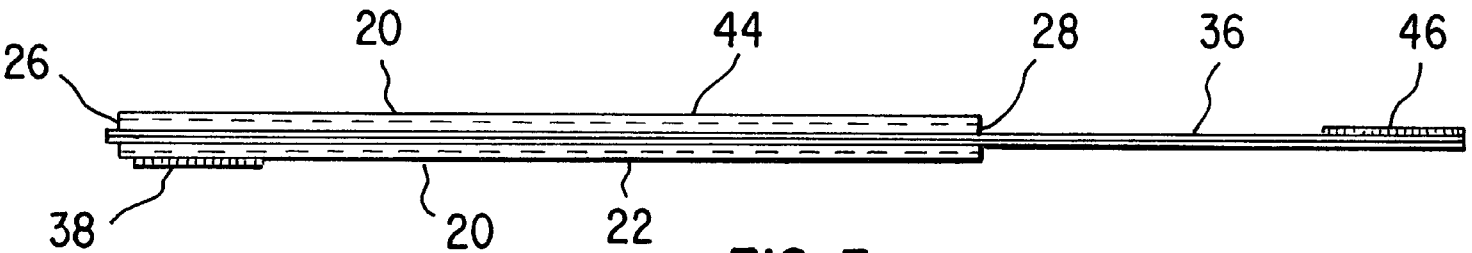
FIG. 3 is a top view of the protective athletic pad.

FIG. 3 is a top view of the protective athletic pad apparatus 10, showing the top portion 24.

Figure 4:
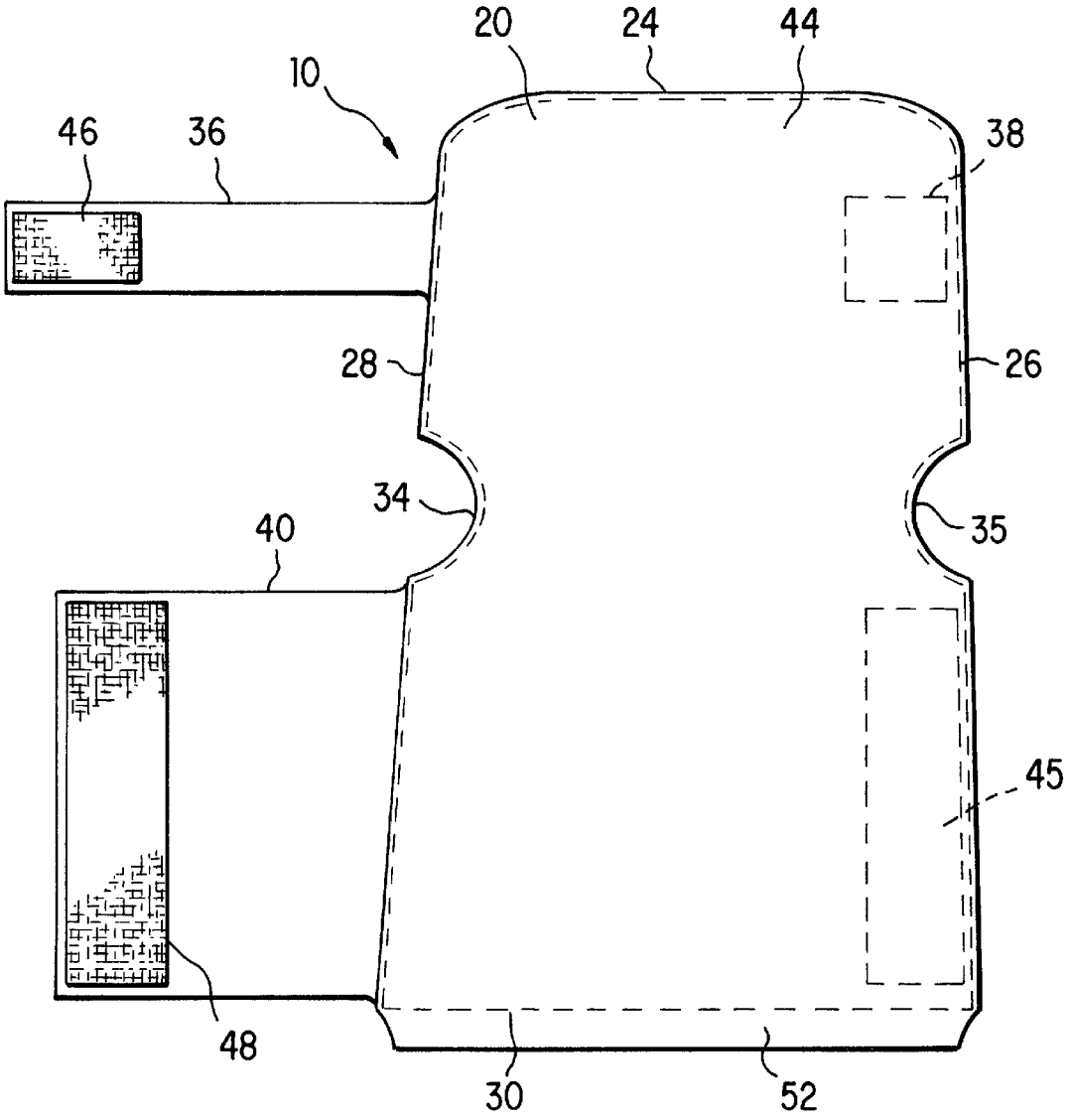
FIG. 4 is a rear elevation view of the protective athletic pad.

FIG. 4 is a rear elevation view of the protective athletic pad apparatus 10, showing the rear portion 44, which is sized similarly to the front portion 22. As shown in the rear elevation view of FIG. 4, the first narrow strap portion 38 has a complimentary first releasable fastening means 46 secured to the rear portion 44. This complimentary first releasable fastening means 46 is releasably secured to the first releasable fastening means secured to the front portion 22 of the fabric 20, when positioned upon a user's 11 leg 16 above the knee 12, or upon the user's 11 arm 18, above the elbow 14.

Likewise, a complimentary second releasable fastening means 48 is secured on the rear portion 44 of the second wide strap portion 40. This complimentary second releasable fastening means 48 is releasably secured to the second releasable fastening means 42 secured on the front portion 22 of the fabric 20, when positioned upon a user's 11 lower leg 16, or forearm 18.

Figure 5:
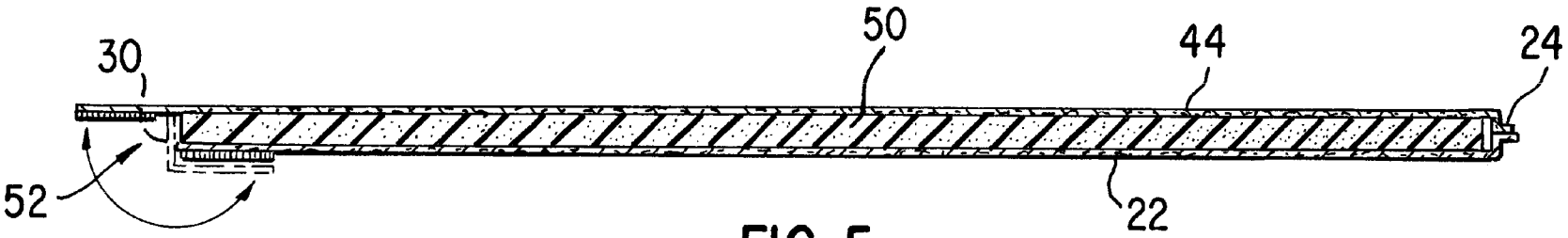
FIG. 5 is a cross sectional view of the protective athletic pad, taken along lines 5—5 in FIG. 2.

FIG. 5 is a cross-sectional view taken along lines 5—5 in FIG. 2. The resilient padding material 50 is clearly shown in this view. The resilient padding material 50 is sized to substantially cover the front portion 22 shown in FIG. 2. Preferably, the resilient padding material 50 is a resilient foam or rubber material, which is selected to be from three-eighths of an inch to one inch thick. This provides additional protection to the user 11 when sliding on the ground, or falling to the ground during strenuous athletic activity.

Figure 1B:
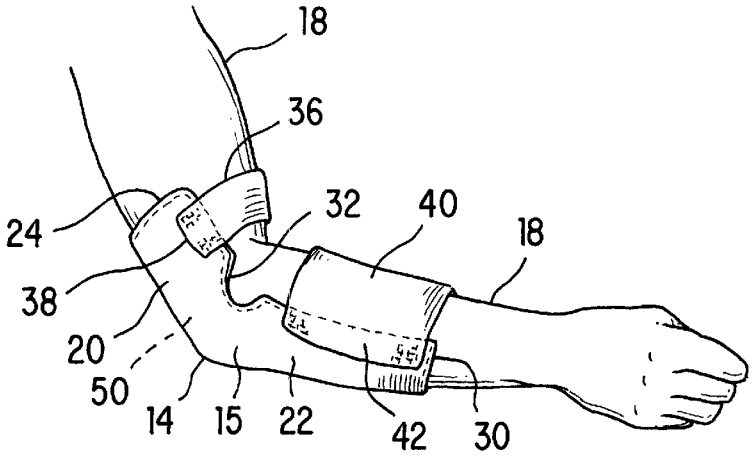
FIG. 1B is a perspective view of the protective athletic pad secured about a user's arm and forearm.

The resilient padding material 50 is sized to cover the front side, inside and outside of the lower leg 16 and knee 12 of either the left or right leg when used as shown in FIG. 1A. Likewise, the resilient padding material 50 is sized to cover the front side, inside and outside of the lower arm 18 and elbow 14 of either the left arm or the right arm of the user 11, when used as shown in FIG. 1B. This enables the user to switch the protective athletic pad apparatus 10 from one leg to the other leg, or from one arm to the other arm, when a protective athletic pad apparatus 10 becomes worn, torn or otherwise damaged.

The protective athletic pad apparatus 10 disclosed herein, protects the user 11 from cuts, scrapes, and skin burns caused by sliding contact with the ground. The protective athletic pad apparatus 10 disclosed herein is easy to position and adjustably secure to suit the preference of the user 11. The fabric 20 and resilient padding 50 are non-stretchable. First elastic narrow strap portion 36 and second elastic wide strap portion 40 allow the user to adjustably tension the protective athletic pad apparatus 10 to suit the user's 11 preference. This is important where strenuous physical activity is conducted while wearing the protective athletic pad apparatus 10.

The first and second cutaway portions 32, 34 are preferably U-shaped cutaway portions, to substantially reduce resistance to bending at the knee 12 or elbow 14 of the user 11. When the athletic pad apparatus 10 is installed upon the leg 16 or arm 18 of a user 11, the first and second cutaway portions 32, 34 are positioned to the inside and outside of the user's joint 15, such as a knee 12 or elbow 14. The joint 15 is covered during use, and thus fully protected by the resilient padding 50, unlike the majority of knee or elbow braces found in the cited prior art.

A releasably secured opening 52 in the fabric 20 may be provided to selectively install and remove various thickness of resilient padding 50, to suit the condition of the ground at game time. The releasably secured opening 52 may be secured with any known releasable fastening means, such as hook and loop type fastener. A second advantage to the releasably secured opening 52 is to replace the resilient padding 50 when ripped or torn during use. Yet another advantage is to remove the resilient padding 50 from the protective athletic pad apparatus 10 for ease of washing and cleaning. The releasably secured opening 52 may be located on the front portion 22, the rear portion 44, the top portion 24, the bottom portion 30, the first side portion 26 or the second side portion 28, to suit user 11 or manufacturing preference. The releasably secured opening 52 is shown in the bottom portion 30 in FIG. 2.

Preferably, the front portion 22 is secured to the rear portion 44 by sewing, gluing, heat sealing, bonding, or by any other known securement means, and all such securement means are intended to be incorporated within the scope of this disclosure, and the following claims. The releasable fastening means 38, 42, are also secured to the front portion 22 by any known securement means. Likewise, the complimentary first and second releasable fastening means are secured to the first and second strap portions 36, 40 by any known securement means.

The fabric 20 may be any desired color or pattern, to suit the needs of the user 11. The user's team colors may also be used, to create a team identity.

The protective athletic pad apparatus 10 disclosed herein, is inexpensive to manufacture, and easy to install or remove about a user's joint 15 and lower limb 17. The protective athletic pad apparatus 10 is adjustable to suit a variety of user shapes and sizes, may be used on either the left or right leg 16, or the left or right arm 18. Thus, the protective athletic pad apparatus 10 may be switched from side to side as one side becomes worn from repeated use. The resilient padding 50 may be adjusted in thickness to suit the needs of the user 11 and the playing conditions on the field. The resilient padding 50 is preferably removable from the protective athletic pad apparatus 10 through the releasabley secured opening 52 for ease of replacement when ripped or torn. The resilient padding 50 is also preferably removable through the releasably secured opening 52 for ease of cleaning and washing between use. The fabric 20 color may be selected to be compatible with the colors of a team, or the preference of the user 11.

Thus, while a specific embodiment of the protective athletic pad apparatus 10 has been disclosed and described herein for purposes of illustration, the protection afforded by any patent which issues upon this application is not strictly limited to the disclosed embodiment, but rather extends to all structures and arrangements which fall fairly within the scope of the following claims.

PARTS LIST

10—adjustable protective athletic pad apparatus
11—user
12—knee
14—elbow
15—joint
16—leg
17—limb
18—arm
20—fabric
22—front portion
24—top portion
26—first side portion
28—second side portion
30—bottom portion
32—first relief cutaway portion
34—second relief cutaway portion
36—first narrow elastic strap portion
38—first releasable fastening means
40—second wide elastic strap portion
42—second releasable fastening means
44—rear portion
46—complimentary first releasable fastening means
48—complimentary second releasable fastening means
50—resilient padding
52—releasably secured opening

What is claimed is:

1. A protective athletic pad apparatus, which comprises:

a) A resilient padding sized to protect the front and sides of a user's joint and to extend above the user's joint and at least six inches below the user's joint to protect the front and sides of a user's joint and lower limb while sliding;

b) a front fabric portion having a top portion, a first side portion, a second side portion, and a bottom portion, the front fabric portion sized to cover the resilient padding;

c) a rear fabric portion having a top portion, a first side portion, a second side portion, and a bottom portion, the rear fabric portion sized to cover the resilient padding;

d) a first cutaway portion located at the user's joint on the first side portion, and a second cutaway portion located at the user's joint on the second side portion;

e) a securement means to secure the front fabric portion to the rear fabric portion, with the resilient padding positioned therein;

f) a first elastic narrow strap portion extending from the second side portion at a location above the user's joint and above the second cutaway portion;

g) a second elastic wide strap portion extending from the second side portion at a location below the user's joint and below the second cutaway portion;

h) a first releasable securement means secured to the front portion of the fabric adjacent to the first side, at a location above the user's joint and above the first cutaway portion; and a complimentary first releasable securement means secured to the rear side of the first narrow strap portion;

i) a second releasable securement means secured to the front portion of the fabric adjacent to the first side, at a location below the user's joint and below the first cutaway portion; and a complimentary second releasable securement means secured to the rear side of the second wide strap portion; and the protective athletic pad apparatus is sized for use on at least one of the user's left and right leg, or on at least one of the user's left and right arm.

2. The protective athletic pad apparatus of claim 1, wherein a releasably secured opening is provided in one of the front fabric portion and the rear fabric portion, and said releasably secured opening is sized to slidably receive the resilient padding between the front fabric portion and the rear fabric portion.

3. The protective athletic pad apparatus of claim 2, wherein the thickness of the resilient padding is selected to be from three-eighths of an inch to one inch in thickness.

4. The protective athletic pad apparatus of claim 3, wherein the thickness of the resilient padding is selected by the user, according to the condition of the playing field, and a selected padding thickness is inserted through the releasably secured opening prior to use.

5. The protective athletic pad apparatus of claim 1, wherein the first and second cutaway portions are opposing, U-shaped portions positioned on the first and second side portions of the protective athletic pad apparatus, said first and second cutaway portions positioned for increased flexibility on each side of a user's joint.

6. The protective athletic pad apparatus of claim 1, wherein the releasable securement means is a hook and loop type fastener.

7. The protective athletic pad apparatus of claim 1, wherein the resilient padding is sized to be six inches to eleven inches wide by ten inches to sixteen inches long by three-eighth of an inch to one inch thick.

8. The protective athletic pad apparatus of claim 1, wherein the first elastic narrow strap portion is from one and one-half inch to two and one-half inch wide by six inches to eight inches long.

9. The protective athletic pad apparatus of claim 1, wherein the second elastic wide strip portion is from six inches to eight inches wide by six inches to eight inches long.

10. A protective athletic pad apparatus, which comprises:

a) resilient padding sized to protect the front and sides of a user's joint and limb while sliding, and to flexibly extend above the user's joint and at least six inches below the user's joint;

b) a front fabric portion having a top portion, a first side portion, a second side portion, and a bottom portion, the front fabric portion sized to cover the resilient padding;

c) a rear fabric portion having a top portion, a first side portion, a second side portion, and a bottom portion, the rear fabric portion sized to cover the resilient padding;

d) a first cutaway portion located on the first side portion of the resilient padding, and a second cutaway portion located on the second side portion of the resilient padding, the first and second cutaway portions are opposing, U-shaped portions positioned on the first and second side portions of the adjustable protective athletic pad apparatus on each side of the user's joint, said first and second cutaway portions positioned for increased flexibility about a user's joint;

e) a securement means to secure the front fabric portion to the rear fabric portion, with the resilient padding positioned between the front fabric portion and the rear fabric portion;

f) a first elastic narrow strap portion extending from the second side portion at a location above the joint and above the second cutaway portion;

g) a second elastic wide strap portion extending from the second side portion at a location below the user's joint and below the second cutaway portion;

h) a first releasable securement means secured to the front portion of the fabric adjacent to the first side, at a location above the user's joint and above the first cutaway portion; and a complimentary first releasable securement means secured to the rear side of the first narrow strap portion;

i) a second releasable securement means secured to the front portion of the fabric adjacent to the first side, at a location below the user's joint and below the first cutaway portion; and a complimentary second releasable securement means secured to the rear side of the second wide strap portion;

j) an opening is provided in one of the front fabric portion and rear fabric portion, said opening releasably secured with a hook and loop type fastening means, said opening sized to slidably receive said resilient padding between the front and rear fabric portion; and the protective athletic pad apparatus is sized for use on at least one of the user's left and right leg, or on at least one of the user's left and right arm.

11. The protective athletic pad apparatus of claim 10, wherein the resilient padding is selected to be from three-eighths of an inch to one inch in thickness, and the thickness of the resilient padding is selected by the user, according to the condition of the playing field, and a selected padding thickness is inserted through the releasably secured opening, prior to use.

12. The protective athletic pad apparatus of claim 10, wherein the resilient padding is sized to be six inches to eleven inches wide by ten inches to sixteen inches long by three-eighth of an inch to one inch thick.

13. The protective athletic pad apparatus of claim 10, wherein the first elastic narrow strip portion is from one and one-half inch to two and one-half inch wide by six inches to eight inches long.

14. The protective athletic pad apparatus of claim 10, wherein the second elastic wide strip portion is from six inches to eight inches wide by six inches to eight inches long.

15. A protective athletic pad apparatus, which comprises:

a) a resilient padding sized to protect the front and sides of a user's joint and limb while sliding, and to extend above the user's joint and at least six inches below the user's joint, said resilient padding sized to be six inches to eleven inches wide by ten inches to sixteen inches long by three-eighth of an inch to one inch thick;

b) a front fabric portion having a top portion, a first side portion, a second side portion, and a bottom portion, the front fabric portion sized to cover the resilient padding;

c) a rear fabric portion having a top portion, a first side portion, a second side portion, and a bottom portion, the rear fabric portion sized to cover the resilient padding;

d) a first cutaway portion located on the first side portion of the resilient padding, and a second cutaway portion located on the second side portion of the resilient padding, the first and second cutaway portions are opposing, U-shaped portions positioned on the first and second side portions of the protective athletic pad apparatus, said first and second cutaway portions positioned on each side of the user's joint for increased flexibility;

e) a securement means to secure the front fabric portion to the rear fabric portion, with the resilient padding positioned between the front fabric portion and the rear fabric portion;

f) a first elastic narrow strap portion extending from the second side portion at a location above the user's joint and above the second cutaway portion, said first elastic narrow strip portion is sized from one and one-half inch to two and one-half inch wide by six inches to eight inches long;

g) a second elastic wide strap portion extending from the second side portion at a location below the user's joint and below the second cutaway portion, said second elastic wide strip portion is sized from six inches to eight inches wide by six inches to eight inches long;

h) a first releasable securement means secured to the front portion of the fabric adjacent to the first side, at a location above the user's joint and above the first cutaway portion; and a complimentary first releasable securement means secured to the rear side of the first narrow strap portion;

i) a second releasable securement means secured to the front portion of the fabric adjacent to the first side, at a location below the user's joint and below the first cutaway portion; and a complimentary second releasable securement means secured to the rear side of the second wide strap portion; and j) a releasably secured opening is provided in one of the front fabric portion and the rear fabric portion, said opening sized to slidably receive said resilient padding between the front fabric portion and the rear fabric portion; and the thickness of the resilient padding is selected by the user according to the condition of the playing field, and a selected padding thickness is inserted through the opening and releasably secured therein, prior to use.

16. The protective athletic pad apparatus of claim 15, wherein the protective athletic pad apparatus is sized for use on at least one of the user's left and right leg, or on at least one of the user's left and right arm.

17. The protective athletic pad apparatus of claim 15, wherein the releasable securement means is a hook and loop type fastener.

* * * * *